United States Patent [19]

Wakikaido et al.

[11] Patent Number: 5,014,088

[45] Date of Patent: May 7, 1991

[54] INHIBITABLE IMAGE FORMING APPARATUS INCLUDING ENTERED CODE DATA RELEASE MEANS

[75] Inventors: Takahiro Wakikaido, Yao; Toshio Yoshiyama, Sakai; Ken Yoshizuka, Nagaokakyo, all of Japan

[73] Assignee: Mita Industrial Co., Ltd., Japan

[21] Appl. No.: 433,793

[22] Filed: Nov. 9, 1989

[30] Foreign Application Priority Data

Nov. 19, 1988 [JP] Japan ..... 63-293234

[51] Int. Cl.[5] ..... G03G 21/00

[52] U.S. Cl. ..... 355/201; 355/133; 355/204

[58] Field of Search ..... 355/200, 201, 204, 206, 355/208, 210, 133; 235/375, 380, 382; 364/200

[56] References Cited

U.S. PATENT DOCUMENTS

| | | | |
|---|---|---|---|
| 4,501,485 | 2/1985 | Tsudaka | 355/201 |
| 4,531,826 | 7/1985 | Stoughton et al. | 355/201 |
| 4,681,423 | 7/1987 | Nishijima | 355/210 |

FOREIGN PATENT DOCUMENTS

| | | | |
|---|---|---|---|
| 0025738 | 2/1979 | Japan | 355/201 |
| 0134656 | 8/1983 | Japan | 355/201 |
| 0263165 | 12/1985 | Japan | 355/201 |
| 0091671 | 5/1986 | Japan | 355/201 |
| 9090170 | 5/1986 | Japan | 355/208 |
| 0121866 | 5/1988 | Japan | 355/201 |

*Primary Examiner*—A. T. Grimley
*Assistant Examiner*—William J. Royer
*Attorney, Agent, or Firm*—Beveridge, DeGrandi & Weilacher

[57] ABSTRACT

An image forming apparatus includes a memory having stored code data, code data input keys and a preheat changeover key for selectively switching the fixing device to a preheat mode or an operation ready mode, whereby the apparatus is permitted to operate when code data manually entered by the code data input keys are identical with code data previously stored in the memory. The image forming apparatus further includes entered code data release means responsive to operation of the preheat changeover key for switching the fixing device to the preheat mode, release entered code data whereby the apparatus is inhibited from operating. When the preheat key is pressed, the apparatus is switched to the preheat mode and, at the same time, the entered code data is released. Accordingly, the apparatus requires no dedicated button or key for releasing the entered code data, and may put, to practice use, the preheat changeover means which has been conventionally disposed.

3 Claims, 5 Drawing Sheets

Fig. 3 (A)

DISPLAY 1

17

ENTER 3-DIGIT DIVISION CODE (PRESS PREHEAT KEY AFTER COPYING OPERATION)

Fig. 3 (B)

DISPLAY 2

17

ENTER 3-DIGIT DIVISION CODE 1 2 3

(PRESS PREHEAT KEY AFTER COPYING OPERATION)

Fig. 3 (C)

DISPLAY 3

17

| | | |
|---|---|---|
| B | B | 5 |
| 3 | A | 4 |
| 2 | B | 4 |
| 1 | A | 3 |

COPY READY

123456789

AUTO MAGNIFICATION 141%

Fig. 3 (D)

DISPLAY 4

17

| | | |
|---|---|---|
| B | B | 5 |
| 3 | A | 4 |
| 2 | B | 4 |
| 1 | A | 3 |

COPYING

123456789

AUTO MAGNIFICATION 141%

INHIBITABLE IMAGE FORMING APPARATUS INCLUDING ENTERED CODE DATA RELEASE MEANS

BACKGROUND OF THE INVENTION

The present invention relates to an image forming apparatus such as an electrophotographic copying apparatus, a facsimile or the like, and more particularly to an image forming apparatus having a control function for controlling how often the apparatus is used per operator or per division in a company or the like.

There is known an electrophotographic copying apparatus having a control function (See, for example, Japanese Unexamined Patent Publication No. 134656/1983). According to a conventional apparatus having such a control function, a non-volatile memory has stored code data and the operator is prompted to enter code data with ten keys or the like, before making a copy with the apparatus. If the code data thus entered is not identical with one of the previously stored code data, the operator cannot use the apparatus. Accordingly, when different code data are respectively set and stored for a plurality of divisions of a company, an office or the like which commonly use the same apparatus, the number of copies made or the like per division may be controlled.

In such an apparatus having the control function, it is required to release, after use, the entered code data so as to prevent the apparatus from being freely used by other operators or divisions. The conventional apparatus has a special release button for releasing the entered code data.

A conventional electrostatic memory device having the control function requires a dedicated release button as above-mentioned. This results in an increase in the number of buttons or keys at the operation unit. This not only causes the arrangement of the operation unit to be complicated, but also increases the cost of the apparatus by an amount corresponding to such increase in the number of component elements.

SUMMARY OF THE INVENTION

It is an object of the present invention to provide an image forming apparatus which overcomes the defects of the prior art a above-mentioned.

The image forming apparatus in accordance with the present invention comprises:

memory means having stored code data; code data input means;

control means adapted to permit the apparatus to operate when code data manually entered through the code data input means is identical with code data previously stored in the memory means;

preheat changeover means for switching a heat source in the apparatus to either a preheat mode or an operation ready mode; and entered code data release means adapted to be associated with the operation of the preheat changeover means for switching the heat source to the preheat mode, so that the control means is returned to the state which is provided before the code data is manually entered and where the apparatus is inhibited from operating.

The entered code data release means may also be adapted to release the entered code data when the no copy is made for a predetermined period of time.

According to the present invention, the conventionally existing preheat changeover means is also provided with an entered code data release function. Accordingly, when the preheat changeover means is operated, for instance, by pressing a preheat key, the apparatus is switched to the preheat mode and, at the same time, the entered code data is released.

Thus, the present invention may provide an image forming apparatus which requires no dedicated button or key for releasing the entered code data and which may put, to practical use, the preheat changeover means which has been conventionally disposed.

The above and other features of the present invention will be apparent from the following description with reference to the attached drawings.

BRIEF DESCRIPTION OF THE DRAWINGS

FIGS. 3(A) through 3(D) show various examples of displays by a display.

DESCRIPTION OF THE PREFERRED EMBODIMENTS

In the following embodiment, the description will be made with an electrophotographic copying apparatus taken as an example. However, it is understood that the present invention may also be applied to other image forming apparatus, such as a facsimile other than the electrophotographic copying apparatus.

Figure 5:
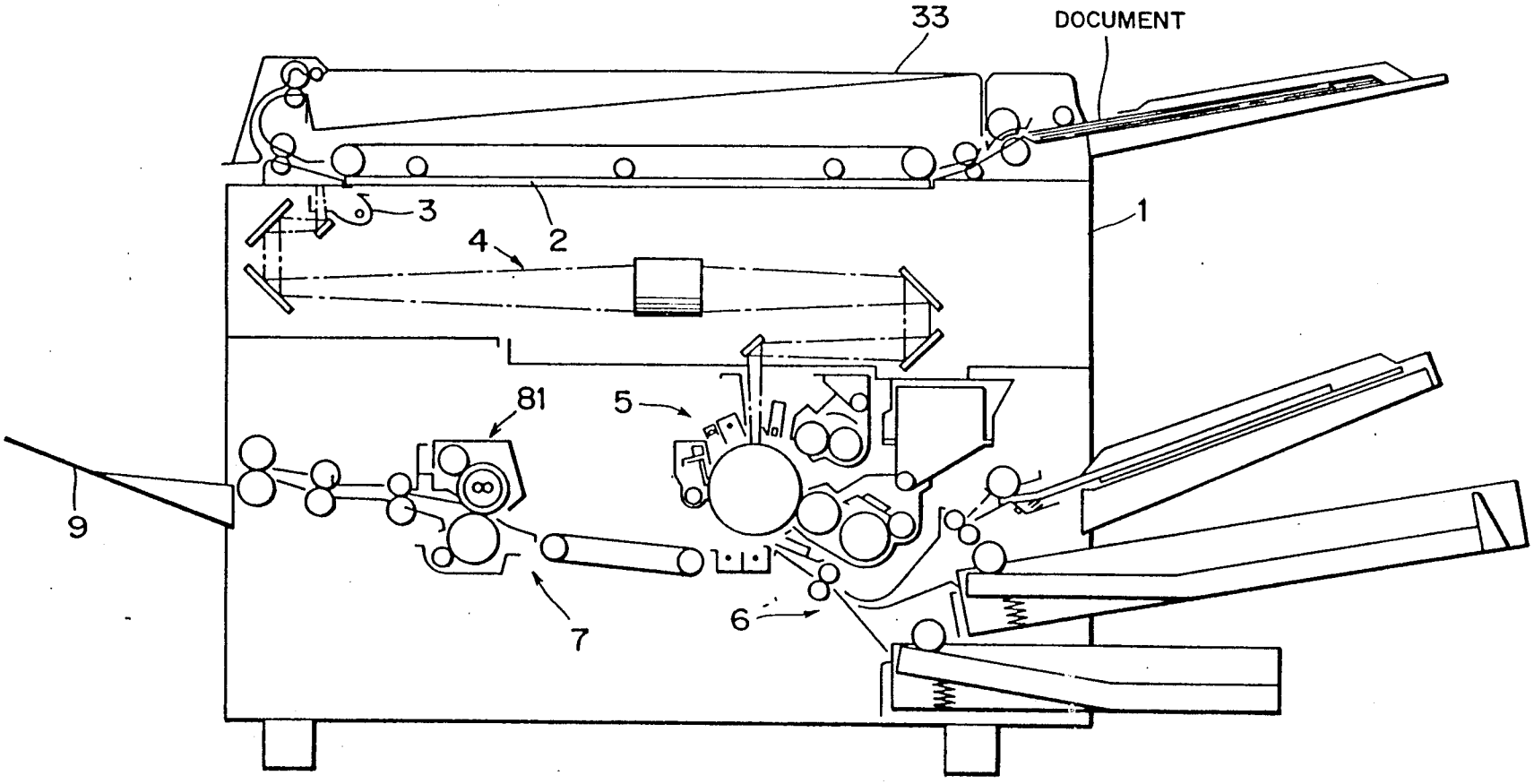
FIG. 5 is a view illustrating the inside arrangement of the electrophotographic copying apparatus.

FIG. 5 is a schematic section view illustrating the arrangement of an electrophotographic copying apparatus in accordance with an embodiment of the present invention.

The electrophotographic copying apparatus has a main body 1 provided at the top surface thereof with a transparent platen 2. Disposed on the transparent platen 2 is a automatic document feeding device 33 for feeding documents, one by one, onto the transparent platen 2.

Incorporated in the main body 1 are: an illumination device 3 for illuminating a document set on the transparent platen 2; an optical system 4 for guiding the light reflected from the document; an image forming mechanism 5 for forming an electrostatic latent image of the document by an electrophotographic method and for developing the image thus formed into a toner image; a copy paper feeding mechanism 6 and a copy paper delivery mechanism 7 for feeding and delivering copy paper; and a fixing device 81 for fixing the toner image transferred onto copy paper. Disposed downstream of the fixing device 81 is a discharge tray 9 for stocking documents for which the copying operation has been made.

Figure 1:
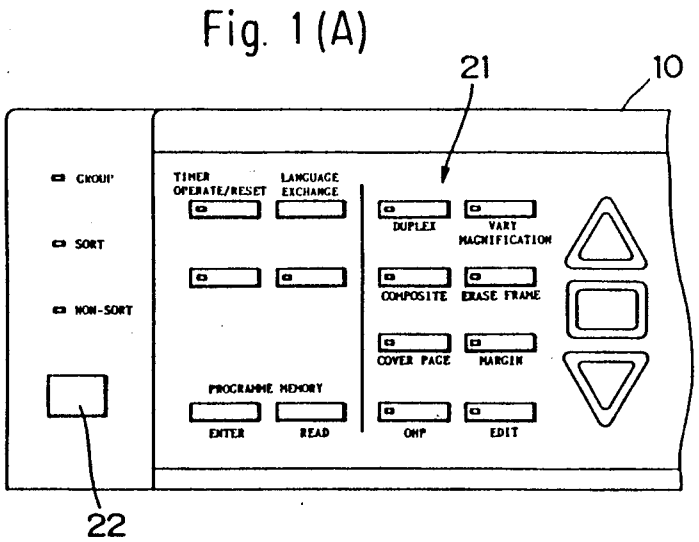
FIG. 1 is a plan view of an operation panel of an electrophotographic copying apparatus according to an embodiment of the present invention.
Figure 1:
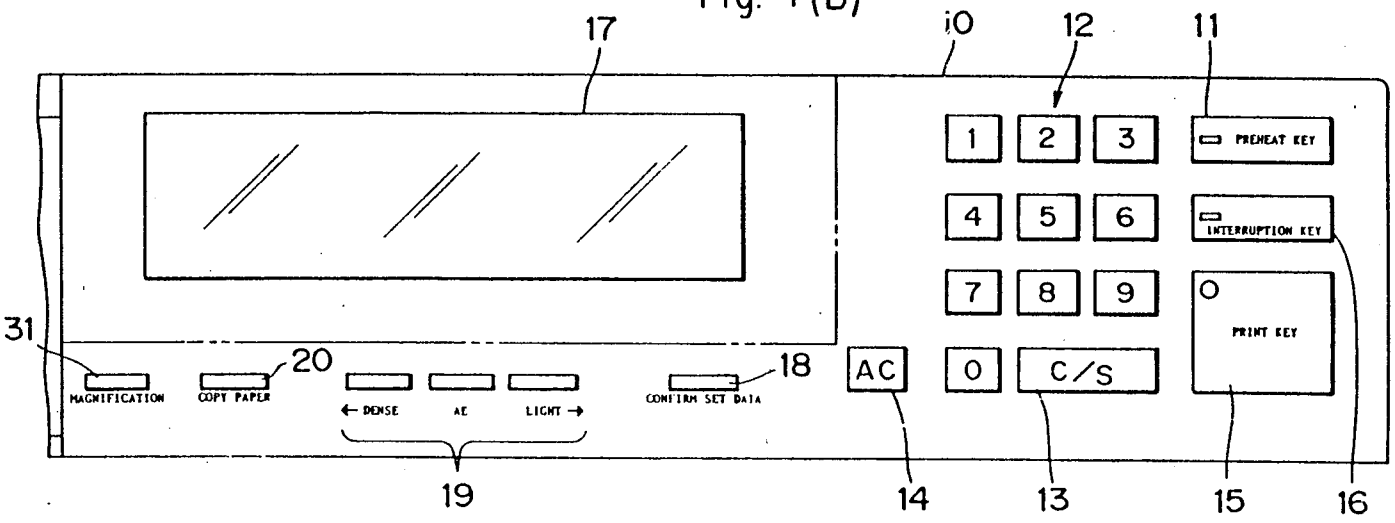

The main body 1 is provided at a predetermined position thereof with an operation panel 10 disposed such that the operator may operate this panel 10. FIG. 1 shows the operation panel 10 in plan elevation.

The operation panel 10 has a preheat key 11 adapted to switch the fixing device 81, which is a heat source for the electrophotographic copying apparatus, to a preheat mode or an operation ready mode. In this embodiment, this preheat key 11 also serves as an entered code release key.

The operation panel 10 also has: ten keys 12 for entering numerical data such as the number of copies to be taken, code data or the like; a clear/stop key 13 for clearing the entered numerical value or for stopping a copying operation under way if data have been erroneously entered through the ten keys 12; an all clear key 14 for clearing all the set data; a print key 15 for starting the copying operation; and an interruption key 16 to be operated for carrying out an interrupt copying operation.

Further, the operation panel 10 has a liquid crystal display device 17 adapted to display the operating procedure of the electrophotographic copying apparatus, the number of copies to be taken and the code data entered through the ten keys 12, or other contents.

The operation panel 10 also has a set data confirming key 18 for making sure of the set contents, a copy density selection key 19, a copy paper selection key 20 and a magnification setting key 31.

The operation panel 10 also has a plurality of special mode setting keys 21 for setting a special copying mode such as a duplex copy, a composite copy, an edit copy or the like, and a sorter instruction key 22. The instructions set or selected by these keys are also displayed on the display device 17. The special mode setting keys 21 may be exposed to the outside at all the times as shown in FIG. 1, but may be covered with an openable cover since these keys are not often operated.

Figure 2:
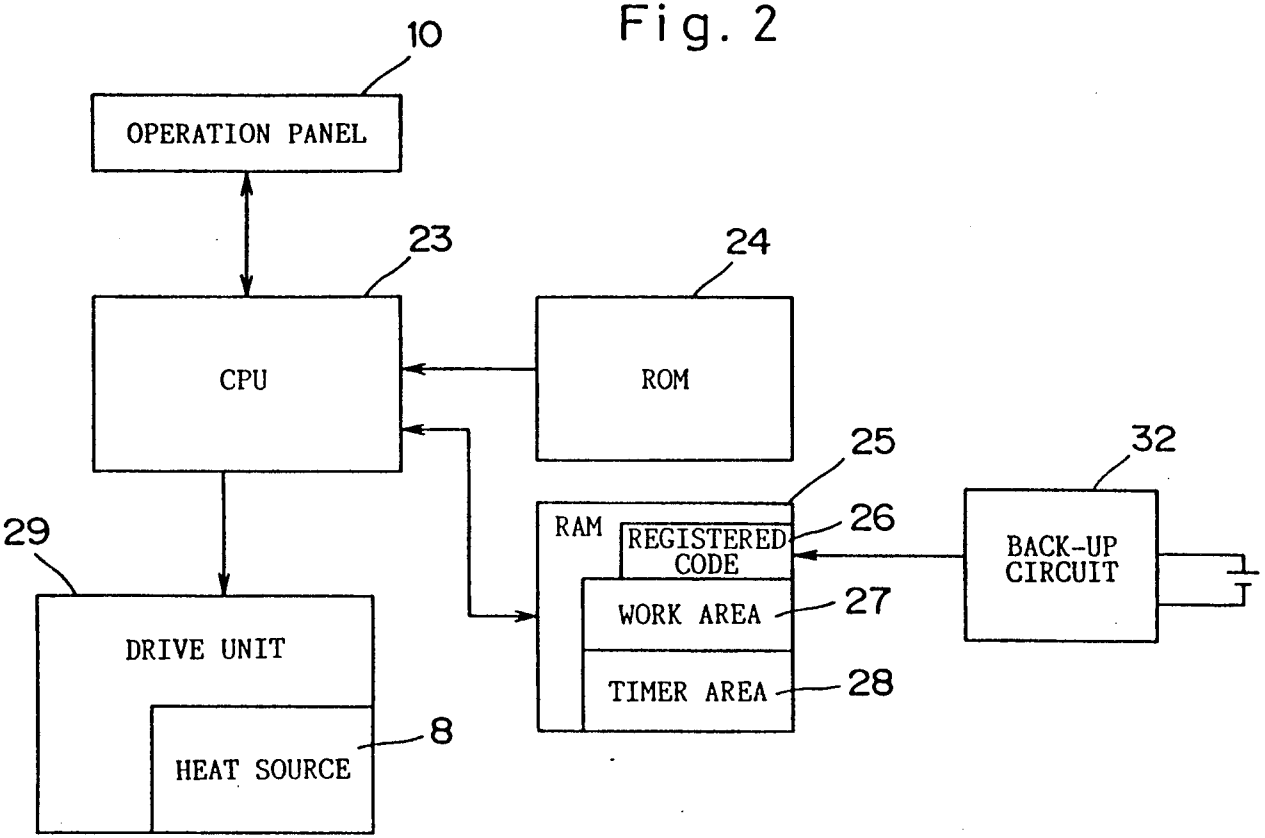
FIG. 2 is a schematic block diagram of a control circuit connected to the operation panel shown in FIG. 1.

This operation panel 10 is connected to a CPU 23 serving as a control center, as shown in FIG. 2. The CPU 23 is connected to a ROM 24 and a RAM 25. The ROM 24 contains an operation program for the CPU 23. The RAM 25 has a registered code memory area 26 which contains predetermined registered codes. At least the registered codes stored in this area 26 are backed up by a back-up power supply 32 such that these codes are not erased even when the power of the electrophotographic copying apparatus is OFF. The RAM 25 has a work area 27 and a timer area 28. The work area 27 is an area for storing code data and the like entered through the ten keys 12. As will be described later, the timer area 28 is an area used for counting elapsed time when no key on the operation panel 10 is operated.

A control signal from the CPU 23 is transmitted to a drive unit 29 of the electrophotographic copying apparatus. This drive unit 29 includes a heat source 8 such as the fixing device 81 and the like as above-mentioned.

FIG. 3 shows more specific examples of contents displayed on the display device 17. FIG. 3 (A) shows an example of Display 1 where the electrophotographic copying apparatus is waiting for entry of a division code. In this state, there are displayed such messages as "Enter a 3-digit division code" and "Press the preheat key 11 upon completion of the copying operation", as shown in FIG. 3 (A).

FIG. 3 (B) shows an example of Display 2 where a division code has been entered.

FIG. 3 (C) shows an example of Display 3 where it is detected that the entered division code is identical with one of the division codes previously stored in the registered code memory area 26, so that the electrophotographic copying apparatus is ready for operation. While watching this display, the operator may select the copy paper with the copy paper selection key 20 and the copy density with the copy density selection key 19, and may set the number of copies to be taken with the ten keys 12.

FIG. 3 (D) shows an example of Display 4 where the copying operation is under way.

Figure 4:
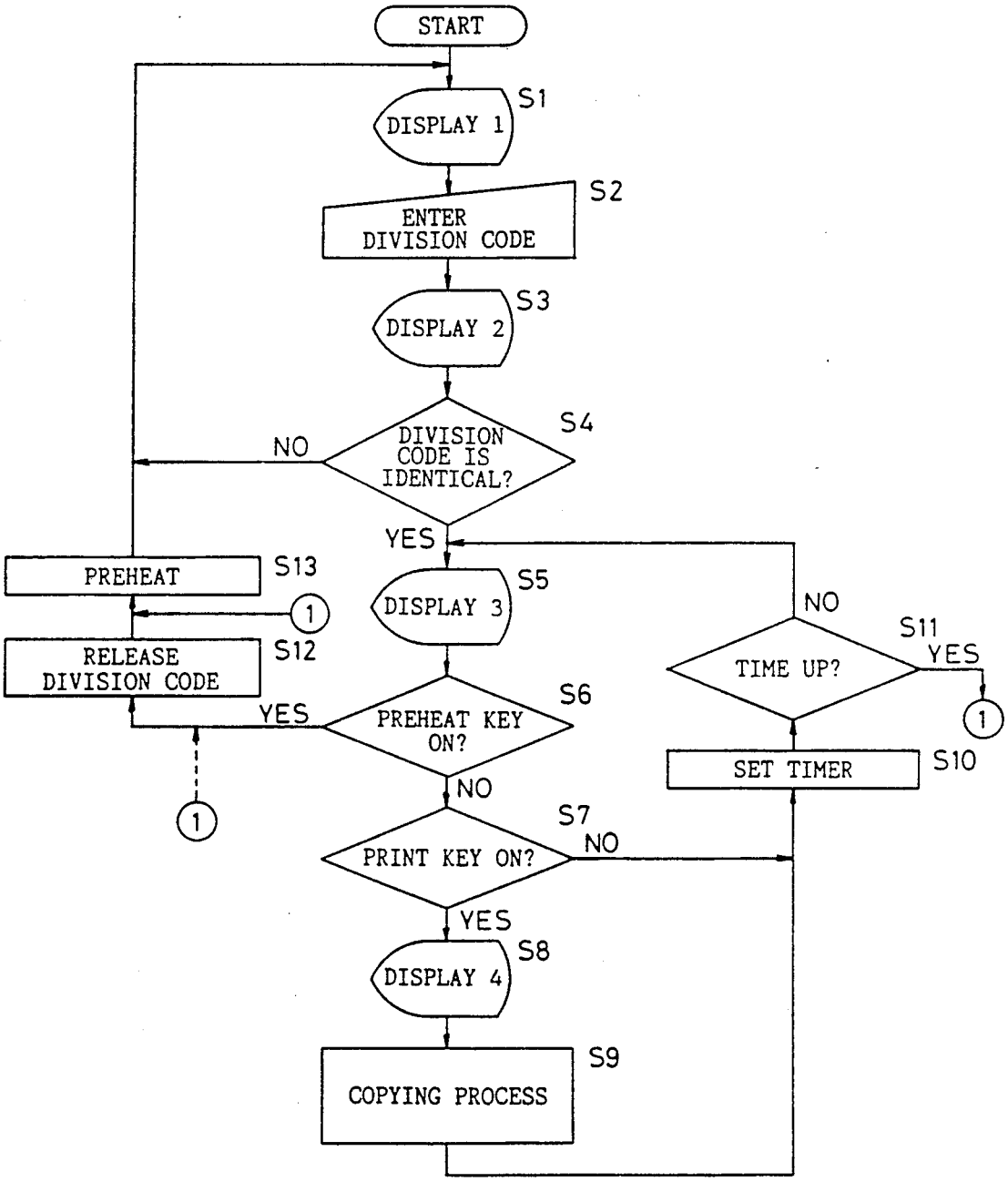
FIG. 4 is a flow chart illustrating the operations of the electrophotographic copying apparatus in accordance with the embodiment of the present invention.

FIG. 4 is a flow chart illustrating the operations of the electrophotographic copying apparatus having the arrangement above-mentioned. With reference to FIG. 1 through FIG. 4, the following description will discuss the operation of this electrophotographic copying apparatus.

When the power of the electrophotographic copying apparatus is turned ON, Display 1 shown in FIG. 3 (A) is displayed on the display device 17 (step S1). According to the instruction of Display 1, the operator enters a 3-digit division code with the ten keys 12 (step S2). When the division code is entered with the ten keys 12, the display shown in FIG. 3 (B) is made on the display device 17 so that the operator may make sure of the entered division code (step S3). The entered division code is stored in the work area 27 in the RAM 25. It is then judged whether or not the entered division code is identical with one of a plurality of division codes previously stored in the registered code memory area 26 (step S4).

If the entered division code is not identical with any of the division codes stored in the registered code memory area 26, the display device 17 may immediately display Display 1 again, or may first display such messages as "The entered division code is erroneous", "Enter the division code again" or the like, and then display Display 1 again.

When the entered division code is identical with one of the stored division codes, the display device 17 displays Display 3 shown in FIG. 3 (C) (step S5), indicating that the electrophotographic copying apparatus is ready for copying.

Then, the operator may operate a variety of keys on the operation panel 10 to set a desired copying mode and start the copying operation with the print key 15.

When the CPU 23 judges that the print key 15 is turned ON (step S7), the CPU 23 causes the display device 17 to display Display 4 shown in FIG. 3 (D) (step S8) and energizes the drive unit 29 to execute copying processing (step S9).

When the print key 15 is not turned ON or when copying processing is complete, the CPU 23 sets the time with the use of the timer area 28 in the RAM 25 (step S10) to start counting a predetermined period of time. Until counting such a predetermined period of time is complete, the operations of steps S5 to S11, or the operations of steps S5 to S7 and steps S10 and S11 are repeated in a cycle.

After a copying operation has been finished, the operator may press, in the middle course of such cycling, the preheat key 11 according to the instructions of Display 1 and Display 2 (step S6), thereby to release the entered division code (step S12). Further, the CPU 23 supplies a control signal to the heat source 8 to preheat the apparatus (step S13).

In this embodiment, provision is made such that, even though the preheat key 11 has not been pressed, when the timer is exhausted, preheating of the apparatus is performed if the print key 15 is not turned ON for a predetermined period of time or if a predetermined period of time has passed after a copying operation has been finished (step S11).

According to the embodiment having the arrangement above-mentioned, when the operator operates the preheat key 11 upon completion of the copying operation, the entered division code or other code data are also released. Thus, the present invention advantageously puts, to practical use, the preheat changeover key which is disposed for power and energy saving.

While the present invention has thus been described with reference to the attached drawings, it will be understood that the invention should not be limited to the particular embodiment above-mentioned. For example, provision may be made such that the entered code data may also be released when the timer is exhausted, as shown by a broken line in FIG. 4. It may be considered that the fact that the timer is exhausted, indicates that the operator has no intention of making a copy or that the operator has forgotten to make a copy. It is therefore desired that other operator is given a chance of making a copy.

It should be understood that the invention may be varied in many other ways without departing from the scope of the invention.

We claim:

1. An image forming apparatus comprising:

memory means having stored code data;

code data input means;

control means for inhibiting image forming by said apparatus unless code data are entered through said code data input means and entered code data are identical with code data previously stored in said memory means;

preheat changeover means for switching a heat source in said apparatus to either a preheat mode or an operation ready mode; and entered code data release means, responsive to switching of said said heat source to said preheat mode by said preheat changeover means, for releasing entered code data whereby said control means inhibits image forming by said apparatus.

2. An image forming apparatus according to claim 1, wherein said entered code data release means comprises times means, and said entered code data release means also releases entered code data when no imager forming operation has been performed by said apparatus for a predetermined period of time measured by said timer means.

3. An image forming apparatus according to claim 1, wherein said heat source is a fixing device for fixing a formed image.

* * * * *